US005271189A

United States Patent [19]

Vincent et al.

[11] Patent Number: 5,271,189

[45] Date of Patent: Dec. 21, 1993

[54] PRESSURE RELIEF PANEL HOLD OPEN APPARATUS AND METHOD

[75] Inventors: William Vincent, Georgetown, Canada; Robert W. Olsen, Washington, N.J.

[73] Assignee: C/S Construction Specialties Limited, Mississauga, Canada

[21] Appl. No.: 895,073

[22] Filed: Jun. 8, 1992

[30] Foreign Application Priority Data

Jun. 13, 1991 [CA] Canada ..... 2044489

[51] Int. Cl.[5] ..... E06B 5/12

[52] U.S. Cl. ..... 52/1; 49/141

[58] Field of Search ..... 52/1; 49/31, 141

[56] References Cited

U.S. PATENT DOCUMENTS 1,887,484 11/1932 Walton ..... 49/31

2,621,377 12/1952 Meyers ..... 49/141

3,453,777 7/1969 Reilly ..... 52/1

FOREIGN PATENT DOCUMENTS 1511489 5/1978 United Kingdom .

*Primary Examiner*—Carl D. Friedman

*Assistant Examiner*—Christopher T. Kent

*Attorney, Agent, or Firm*—Bereskin & Parr

[57] ABSTRACT

A pressure relief panel assembly for protecting a building against over-pressure caused by explosion. The assembly has a panel pivotally connected to a frame and held by a calibrated magnet and striker set which releases when a predetermined over-pressure occurs. A cable restraint attached to a shock absorber, or a linkage of two arms attached to a shock absorber, limits the extent to which the panel can blow open. A spring mounted on one of the arms catches the other arm when the panel has blown open, preventing the panels from reclosing and thereby preventing implosion damage to the building. Alternatively, or additionally, the panel, after opening, may be held partly open by a stop bar which pivots to prevent the panel from fully closing, to prevent implosion damage to the building after the explosion.

22 Claims, 9 Drawing Sheets

PRESSURE RELIEF PANEL HOLD OPEN APPARATUS AND METHOD

FIELD OF THE INVENTION

This invention relates to pressure relief or "blow-out" panels and the like, intended for use in building in which there is a risk of explosion.

BACKGROUND OF THE INVENTION

In buildings such as laboratories, testing facilities and manufacturing plants in which explosions or other sources of high pressure build-up may occur, it is conventional to incorporate in the roof and/or walls of the buildings, panels that will blow-out to relieve over-pressures which may occur inside the building. This is necessary to prevent the building from collapsing and to minimize injury to persons inside the building.

Blow-out panels have in the past been retained by mechanical devices such as shear bolts which are designed to break under a predetermined load and allow the panel to blow-out. In this type of system it has been difficult to adjust accurately the pressure at which a particular panel will blow-out. In addition, as the system ages and corrodes, the pressure at which blow-out will occur tends to change. Further, when a panel has blown-out, part or all of the panel or at least the shear bolts are destroyed and must be replaced.

Accordingly, the assignee of the present invention, C/S Construction Specialties Limited of Mississauga, Ontario, Canada has developed a new pressure relief panel arrangement in which a calibrated magnet and striker set is used to hold the panel closed. The magnet has a maximum holding force substantially exceeding the known force to which it is subjected at the predetermined blow-open pressure, and at least one non-magnetic shim is used of thickness selected to reduce the magnet holding force to the known force. This system is described in Canadian patent 1,241,517 issued Sep. 6, 1988 entitled "PRESSURE RELIEF PANELS AND LOUVERS".

It has been discovered during tests of the system described in the above Canadian patent, that when an explosion occurs in a building protected by the panels, the panels blow open rapidly but may then tend to re-close quickly due to implosive forces which occur immediately after an explosion. Specifically, super heated gases which are created during an explosion rapidly cool and contract immediately after the explosion. This contraction causes an "implosive" or vacuum type condition which draws the panels closed. The resultant forces, if not addressed, are transferred to the building's structure and, depending on their magnitude, may cause considerable damage.

Therefore, it is an object of the invention to provide an arrangement and method in which, after a pivotally connected blow-open panel has been blown open at least to a predetermined extent, the panel is then held at least partly open to reduce the likelihood of implosion damage in the building being protected.

SUMMARY OF THE INVENTION

In one aspect the invention provides in a pressure sure relief panel assembly for protecting a building against over-pressure, said assembly including a frame, a panel pivotally coupled to the frame for movement between a normal closed position and an opened position, and panel release means normally holding said panel in closed position but adapted to release when the panel is subjected to a predetermined blow-open pressure, the improvement comprising a hold-open mechanism for holding said panel at least partly open after it has been opened by over-pressure in said building, said hold-open mechanism comprising means coupled to one of said panel and said frame and responsive to the opening of said panel to at least a predetermined extent for thereupon holding said panel at least partly open, whereby to reduce the likelihood of implosion in said building.

In another aspect the invention provides a method of protecting a building against over-pressures in said building, said method comprising providing a panel pivoted to said building at a pivot point for said panel to blow open about said pivot point upon the occurrence of an over-pressure in said building, and holding said panel at least partly open after said panel has blown open, thereby to reduce the likelihood of damage due to implosion in said building.

Further objects and advantages of the invention will appear from the following description, taken together with the accompanying drawings.

DETAILED DESCRIPTION OF PREFERRED EMBODIMENTS

Figure 1:
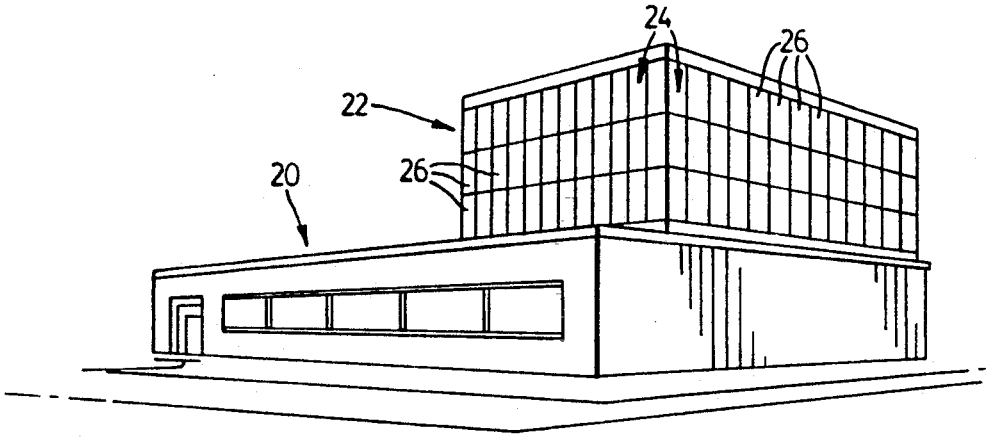
FIG. 1 is a perspective view of a typical building provided with an array of pressure relief wall panels.

Reference is first made to FIG. 1, which shows a building 20 having a section 22, for example a laboratory section, in which there is a risk of explosion. The walls of section 22 include arrays 24 of pressure relief or blow-out wall panel assemblies 26.

Figure 2:
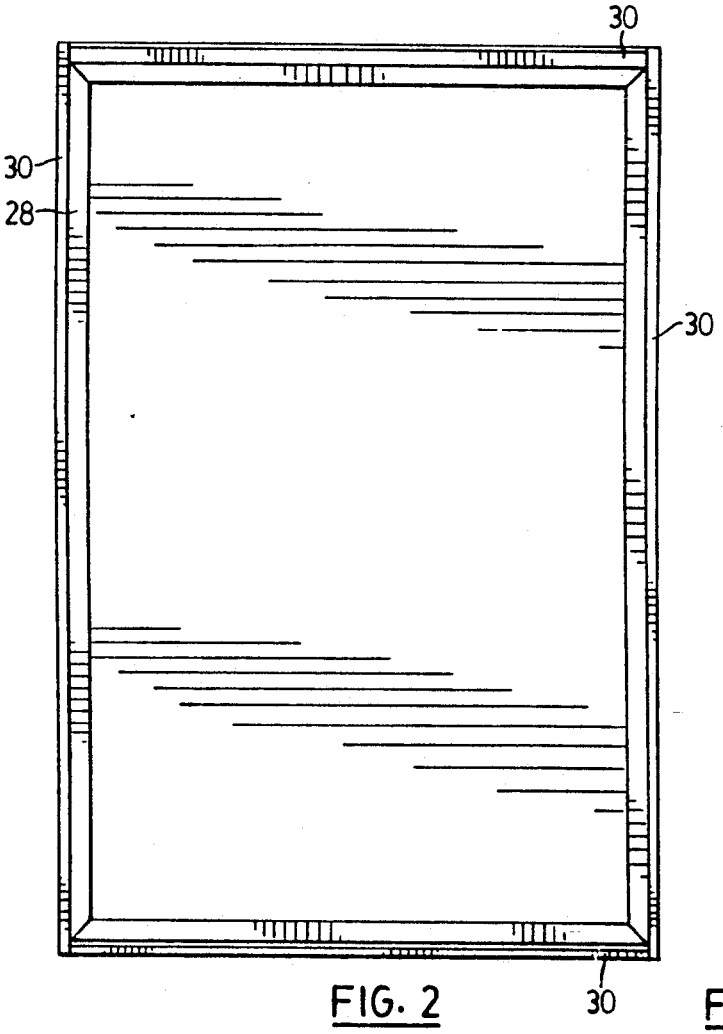
FIG. 2 is a front view of a panel and frame of FIG. 1.

The wall panel assemblies 26 are fully described in the above identified Canadian patent and will be described here only briefly, with reference to FIGS. 2 and 3. As shown, the panel assembly 26 includes a panel member 28 surrounded by a frame 30. The frame 30 is connected to the building structure by clips or brackets (not shown) and effectively forms part of the building structure. The panel member 28 is pivotally connected to the frame 30 by a pivot shaft 32. Pivot shaft 32 extends through the panel member 28 and outwardly through the side members of the frame 30. The shaft 32 is typically held stationary with respect to the panel by a set screw (not shown) and is journalled in suitable bushings (not shown) in the sides of the frame 30.

The panel member 28 is normally held closed by a magnet 36 (FIG. 4) carried by a support bracket 38 connected to the frame 30. Bolts 39 hold the magnet in position. The magnet 36 cooperates with a striker plate 40 connected to the back of the panel member 28 by bracket 42. Bracket 42 is screwed and/or glued to the back of panel member 28.

One or more non-magnetic shims (e.g. of brass), one of which is indicated at 44, are placed on the top surface of the striker plate 40 to calibrate the holding force between the magnet and striker plate. As described in the above mentioned Canadian patent, the magnet is of greater force than required, and the magnetic holding force is reduced by the shims 44 to a desired known force so that the panel will blow open at a predetermined over-pressure in the building being protected.

Figure 3:
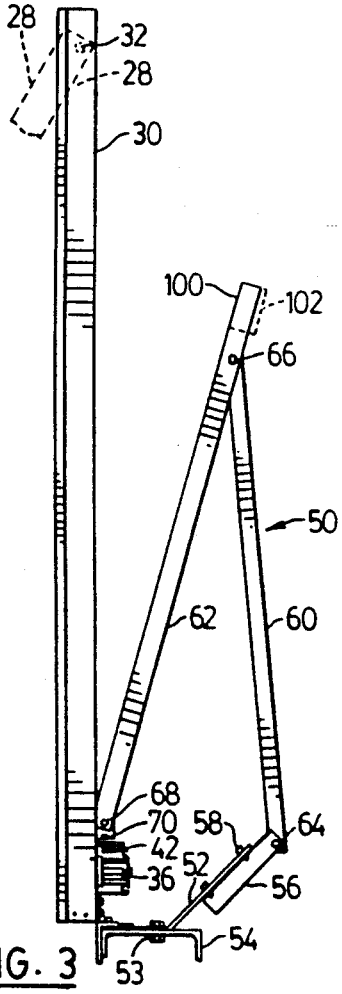
FIG. 3 is a side view of the panel and frame of FIG. 2.
Figure 4:
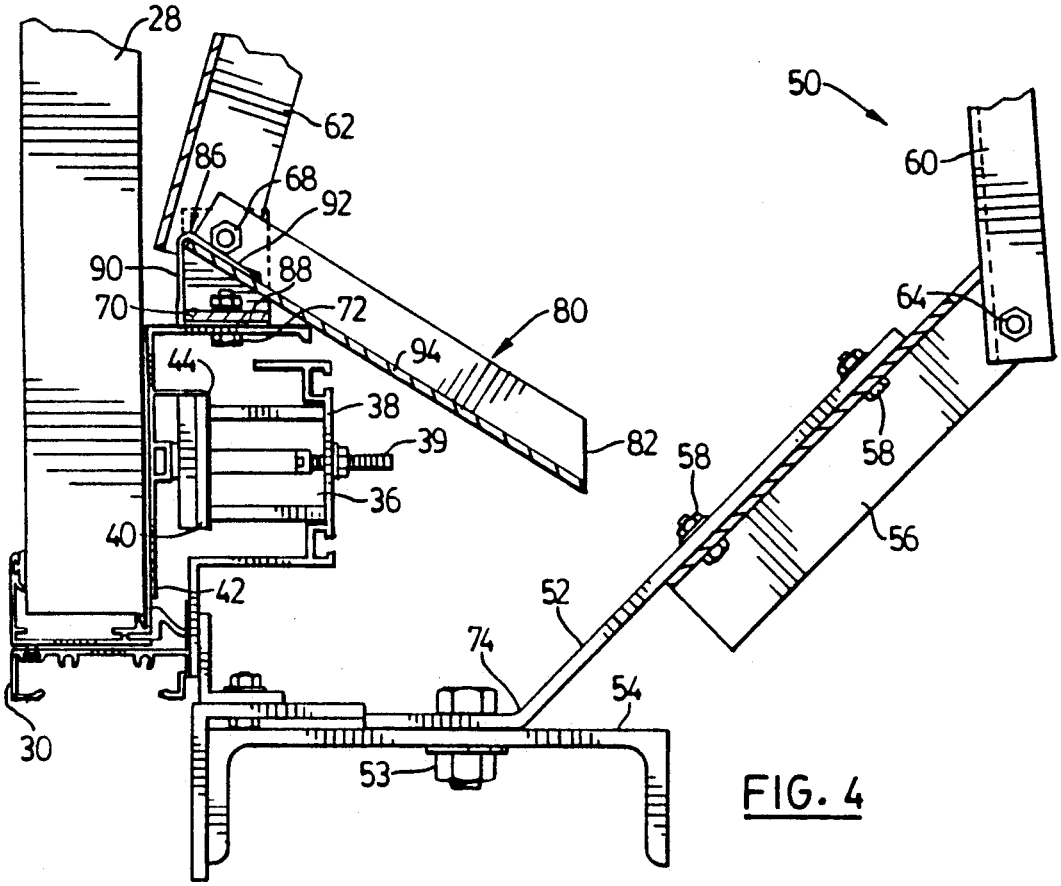
FIG. 4 is a side elevational view of a first embodiment of a hold open mechanism for the panel of FIG. 3.

The extent to which the panel member 28 can open is controlled by a linkage indicated at 50 in FIGS. 3 and 4. The linkage 50 includes an angled flat plate bracket 52 bolted at 53 to channel 54 which is secured to the building structure; an intermediate channel 56 bolted at 58 to the bracket 52, and a pair of arms 60, 62. The arms 60, 62 are each of U-channel configuration. The first arm 60 is pivotally connected at 64 to the intermediate channel 56, and the second arm 62 is pivotally connected at 66 to the first arm 60. The second arm 62 is also pivotally connected at 68 to a mount 70. The mount 70 is bolted at 72 to the bracket 42 attached to the rear of panel member 28.

When the panel member 28 blows open, the arms 60, 62 pivot about pivot points 64, 66, 68 until they are in a straight line. At this point the panel member 28 has opened to an angle which is about 60 degrees from the vertical. The panel member 28 in partly open position is indicated in dotted lines in FIG. 3. Beyond the 60 degree open position, flat plate bracket 52 tends to bend about angle 74. The bracket 52 acts like a shock absorber by bending, and therefore reduces the likelihood of destruction of both the arm system and the panel in the case of a very violent explosion. Bracket 52 can be replaced if necessary.

Figure 5:
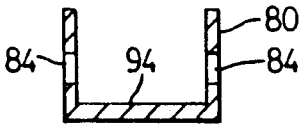
FIG. 5 is a sectional view of a stop member of the FIG. 4 mechanism.
Figure 6:
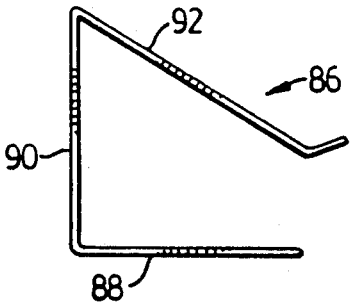
FIG. 6 is a side view of a spring of the FIG. 4 mechanism.

As mentioned, after the panel member 28 has been forced open because of an explosion within the building, it is desirable to prevent it from re-closing completely, to prevent damage due to an implosion or vacuum within the building. Therefore a stop member 80 shown in FIGS. 4 and 5 is provided. Stop member 80 is formed of a U-channel section (FIG. 5) with an angled front face 82 and pivot holes 84. Stop member 80 is pivotally connected (through holes 84, FIG. 5) to the mount 70 (which as mentioned is in turn fastened to bracket 42 by bolts 72). The lower surface of stop member 80 normally rests on the upper edge of bracket 42, as shown in FIG. 4. A spring 86 (FIG. 6) biases stop member 80 downwardly, to prevent stop member 80 from flipping up. Spring 86 is generally U-shaped, having a lower leg 88, a vertical wall 90, and a downwardly sloping upper leg 92 which overlies the web 94 of stop member 80. Lower leg 88 is secured by being held between mount 70 and the upper flange of bracket 42.

Figure 7:
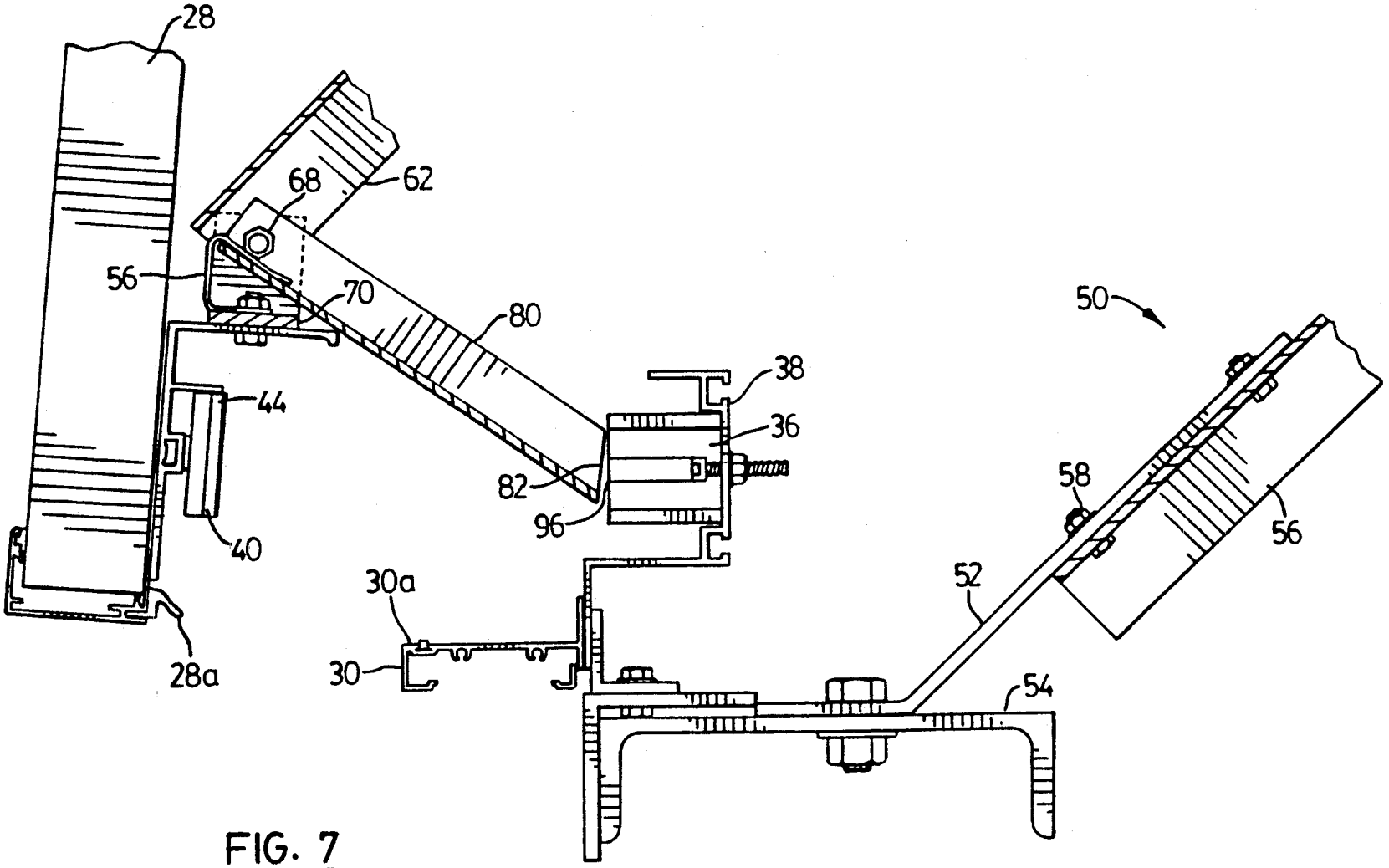
FIG. 7 is a view similar to that of FIG. 4 but showing the panel member partly open and the stop member engaged.

When the panel member 28 is blown open by an explosion, the stop member 80 pivots downwardly slightly. Then, as the panel member 28 begins to close, the face 82 of stop member 80 moves against the front face 96 of the magnet 36 (FIG. 7), preventing the panel member 28 from fully closing. The face 82, which is angled at about 60 degrees to the axis of member 80, rests substantially flush with the magnet face. The spring 86 allows some resilience but prevents stop member 80 from flipping up.

To re-close the panel member 28, the panel member 28 is opened slightly and the stop member 80 is pivoted upwardly (against spring 86) to clear the magnet 36 and magnet support bracket 38. The panel member 28 then can be re-closed, after which stop member 80 again assumes the position shown in FIG. 4.

Typically the stop member 80 will be between six and eight inches long, but its length can be adjusted as required, depending on the extent to which it is desired to hold panel member 28 open after it has blown open. The extent to which the panel member 28 must be held open will depend on factors such as the size and number of the panels, and the volume of the space being protected, but typically the bottom inner edge **28*a* (FIG. 7) of the panel should be held between two and ten inches away from the bottom outer edge 30*a*** of the inside perimeter of the frame. A preferred distance is four to five inches. This is much less than the amount which the panel opens, but it is found generally sufficient.

While the arms 60, 62 have been shown as operating in a vertical plane, they can instead be arranged to operate in a horizontal plane, if desired. In addition, while they are shown as made from U-shaped stock, other structural shapes can be used.

Figure 8:
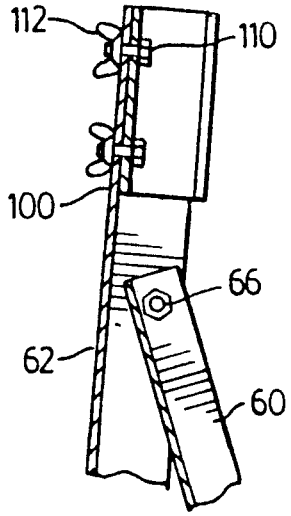
FIG. 8 is an elevational view of a portion of the FIG. 3 arrangement showing a modified hold open mechanism.
Figure 9:
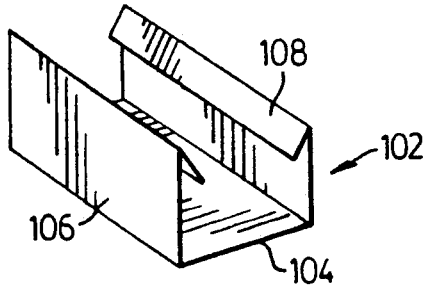
FIG. 9 is a perspective view of a spring of the FIG. 8 arrangement.
Figure 10:
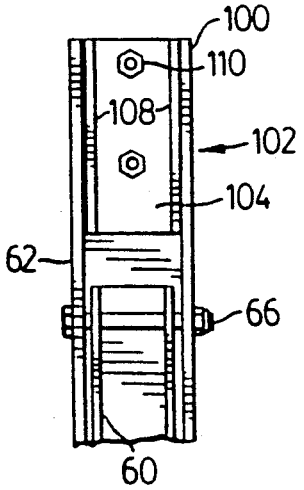
FIG. 10 is another elevational view of the FIG. 8 arrangement.

Reference is next made to FIGS. 8 to 10, which show a different arrangement for holding the panel member 28 open after it has blown open. It will be seen that as shown in FIG. 3, the second arm 62 extends beyond the pivot connection 66 as an arm extension 100. Arm extension 100 carries a U-shaped spring 102, which is shown in dotted lines in FIG. 3 since it is an alternative to stop member 80.

Figure 12:
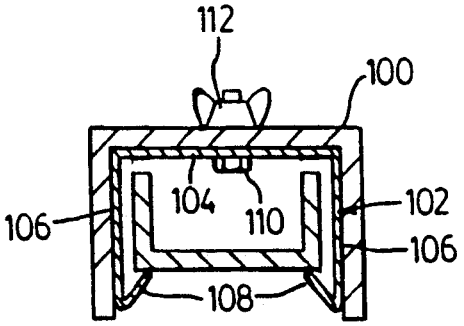
FIG. 12 is a sectional view on lines 12—12 of FIG. 11.

Spring 102 is shown in detail in FIG. 9. As shown, spring 102 has a base 104, upstanding legs 106, and inturned edges or "barbs" 108 at the tops of legs 106. The base 104 is mounted on arm extension 100 by bolts 110 and wing nuts 112, as shown in FIGS. 8, 10 and 12, with the spring 102 inside the channel of extension 100. The barbs 108 face away from arm extension 100, in a direction to receive arm 60 when the arms pivot into a straight line as the panel member 28 blows out.

Figure 11:
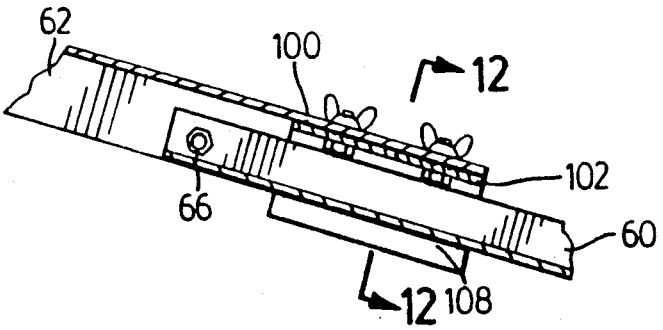
FIG. 11 is a view similar to FIG. 8 but showing the spring engaged.

When an explosion within the building blows the panel member 28 outwardly, i.e. open, the first and second arms 60, 62 straighten as shown in FIG. 11. This propels the end part of the first arm 60 nearest the pivot connection 66, into the spring 102. The inturned edges or barbs 108 of the spring 102 are forced apart and then snap out to grip the first arm 62 as shown in FIGS. 11 and 12, holding the two arms 60, 62 in a straight line and preventing panel member 28 from closing.

To close the panel member 28, the wing nuts 112 are removed, detaching the spring 102 from the second arm 62. The spring 102 can then be conveniently removed from the first arm 60 and re-attached by the wing nuts to the second arm 62. Alternatively the spring 102 may be held to arm 62 by two rivets (not shown), in which case detachment occurs simply by using locking pliers to snap the barbs 108 of the spring 102 away from arm 62.

If desired, the stop member 80 can be used with the spring 102, as a backup to the spring. Also, instead of spring 102, any other desired catch system can be used to catch the arms 60, 62 and hold them straight once they have moved to a straight configuration.

Reference is next made to FIGS. 13 to 16, which show another embodiment of the invention. In FIGS. 13 to 16 primed reference numerals indicate parts corresponding to those of FIGS. 1 to 12.

The FIGS. 13 to 16 embodiment deal with the problem that in the FIGS. 1 to 12 embodiment, the shock absorber bracket 52, the linkage 50 and the stop member 80 project into the interior of the building when the panel member 28 is closed. Sometimes the space that they occupy is needed for other purposes.

Figure 13:
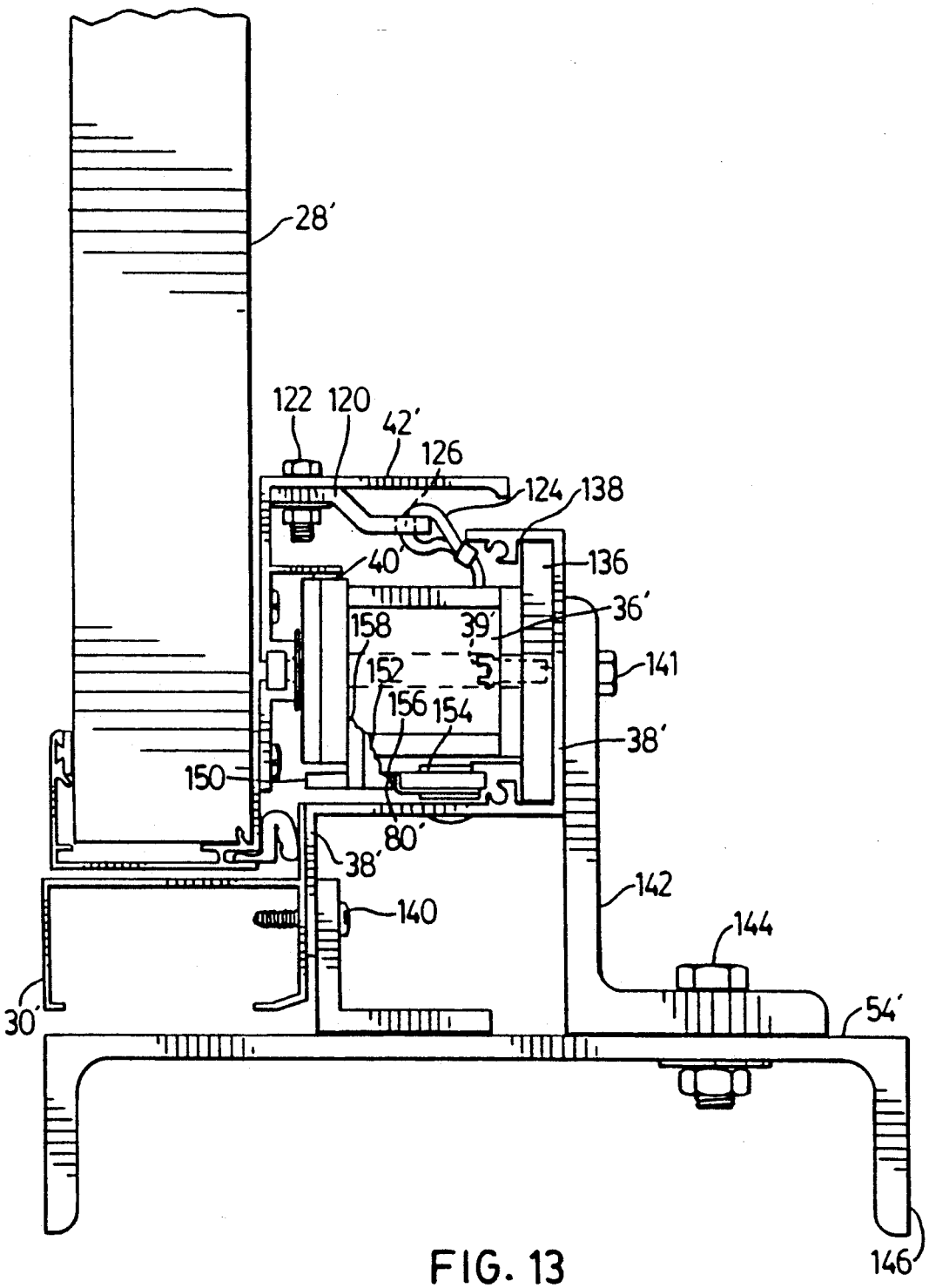
FIG. 13 is a side elevational view similar to FIG. 4 but of a further embodiment of the invention.
Figure 14:
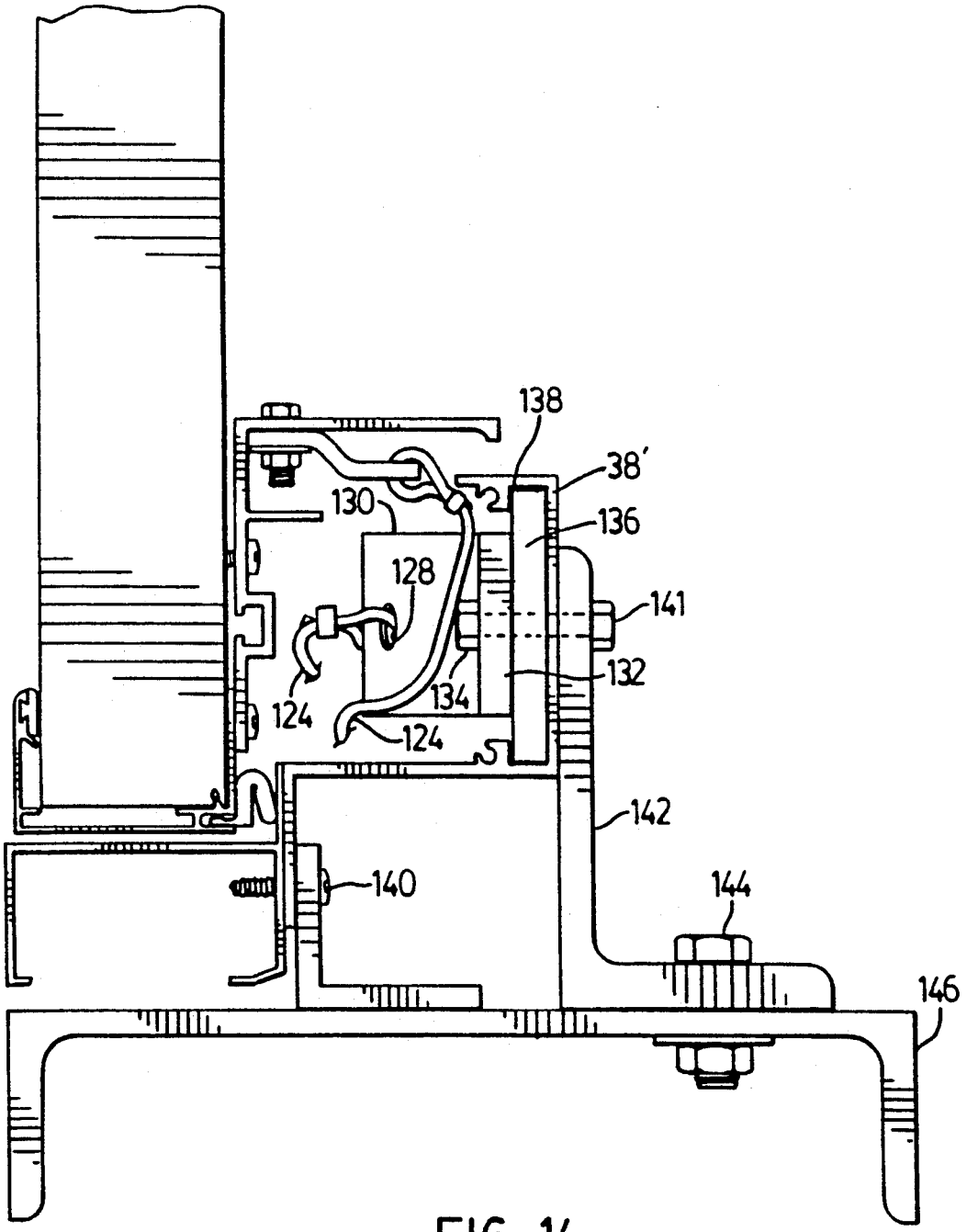
FIG. 14 is a view similar to FIG. 13 but showing more detail of a shock absorber bracket.
Figure 15:
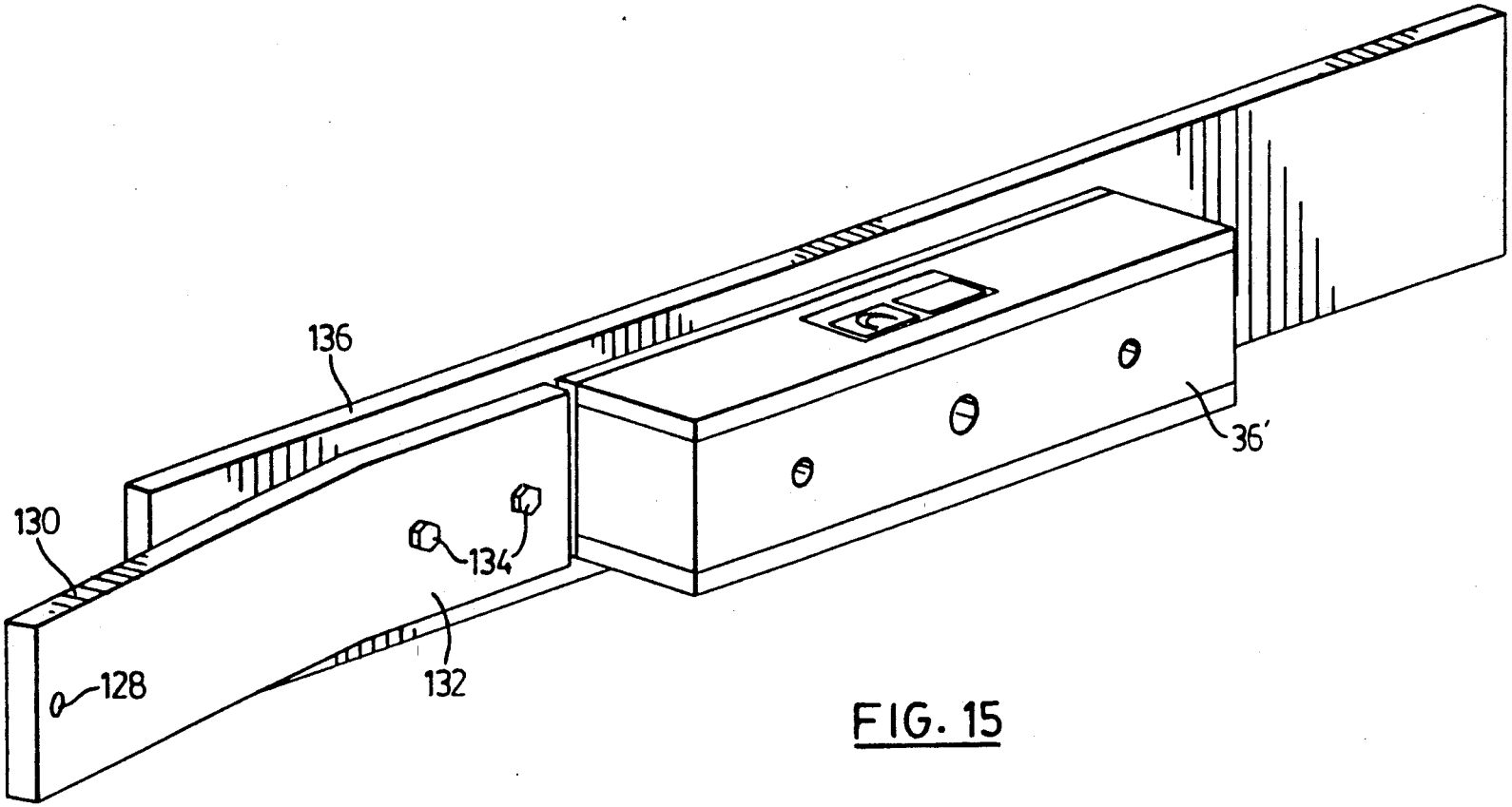
FIG. 15 is a perspective view showing a shock absorber bracket, backing bar and magnet of FIGS. 13 and 14 in more detail.

In the FIGS. 13 to 17 embodiment, the linkage 50 has been eliminated and its function as a panel restraint device, holding the panel from blowing out too far, is performed by a cable restraint arrangement. The cable restraint arrangement includes a cable restraint bracket 120 secured to bracket 42' by bolt 122. A cable 124 passes through a hole 126 in the end of bracket 120 and, as shown in FIGS. 14 and 15, passes through a hole 128 in the bent end 130 of a shock absorber bracket 132. The shock absorber bracket 132 is bolted by bolts 134 to a strong metal (e.g. steel or heavy aluminum) backing bar 136. Backing bar 136 is fitted into a channel 138 in support bracket 38'. Bracket 38' is as before secured to the frame 30 (by bolt 140). However in addition, and as best shown in FIG. 14, bolts 141 extend through a strong metal angle 142 (e.g. steel, or heavy aluminum) which is secured by bolts 144 to a steel structural channel 146 which is firmly secured to the building.

The backing bar 136 and its connection through angle 142 to channel 146 are provided because when the panel is blown open, very large loads are generated when the panel is stopped. The load which is imposed on the shock absorber bracket 132 when the panel is stopped is now transferred to the backing bar 136, and then through angle 142 to channel 146 of the building, so that the thinner aluminum components of the frame are not exposed to high forces when the panel is blown open. The bent end 130 of the shock absorber bracket 132 will bend if necessary, to absorb excess loads, and also, since it is bent away from backing bar 136, it provides space between shock absorber bracket 132 and the backing bar 136 to allow the cable 124 to be tied around the shock absorber bracket.

Figure 16:
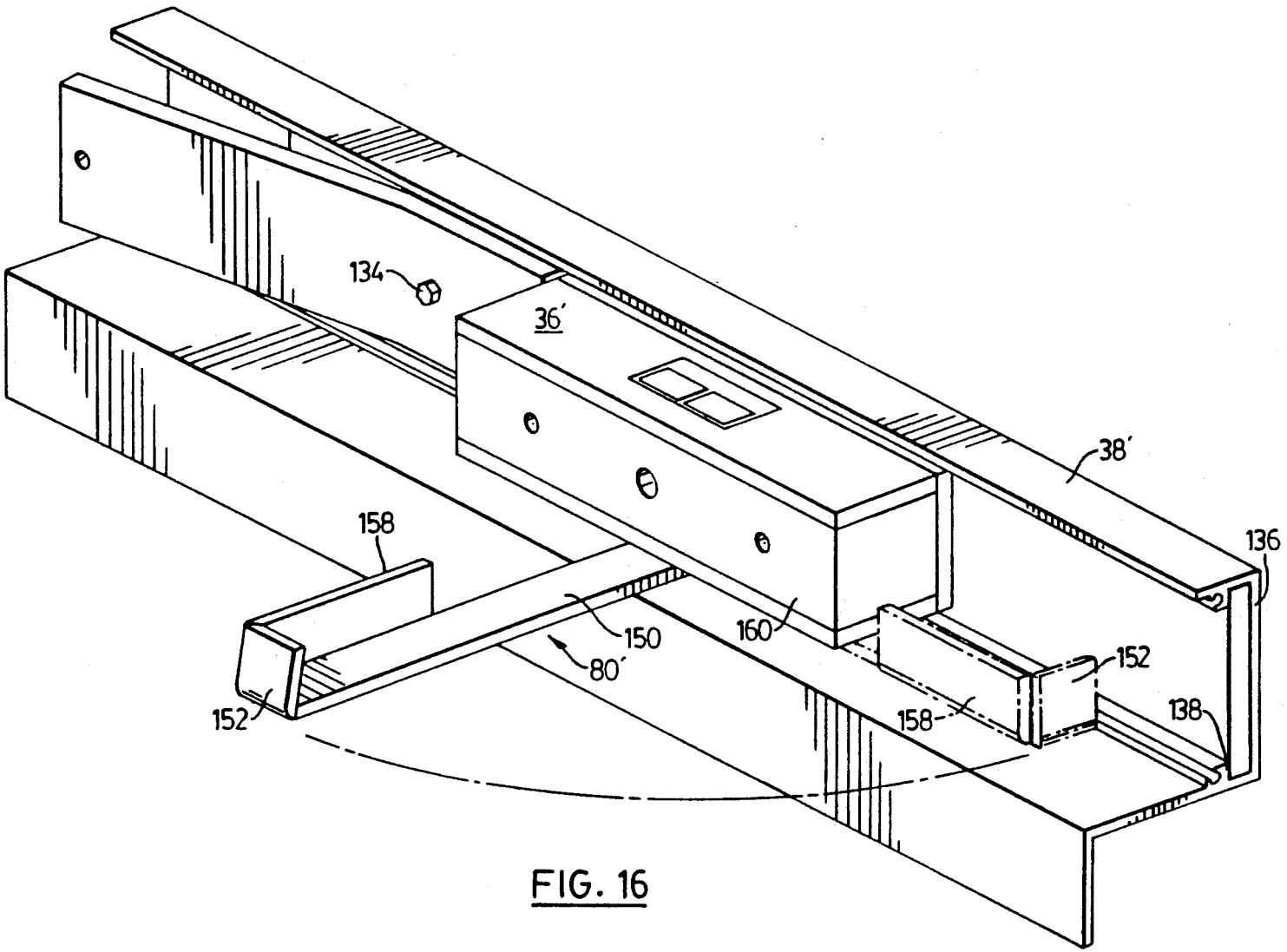
FIG. 16 shows the parts of FIG. 15 mounted on a channel and with a hold open bar in both open and closed positions.

The backing bar 136 also serves as a mount for the magnet 36', as best shown in FIGS. 13 and 16.

Figure 17:
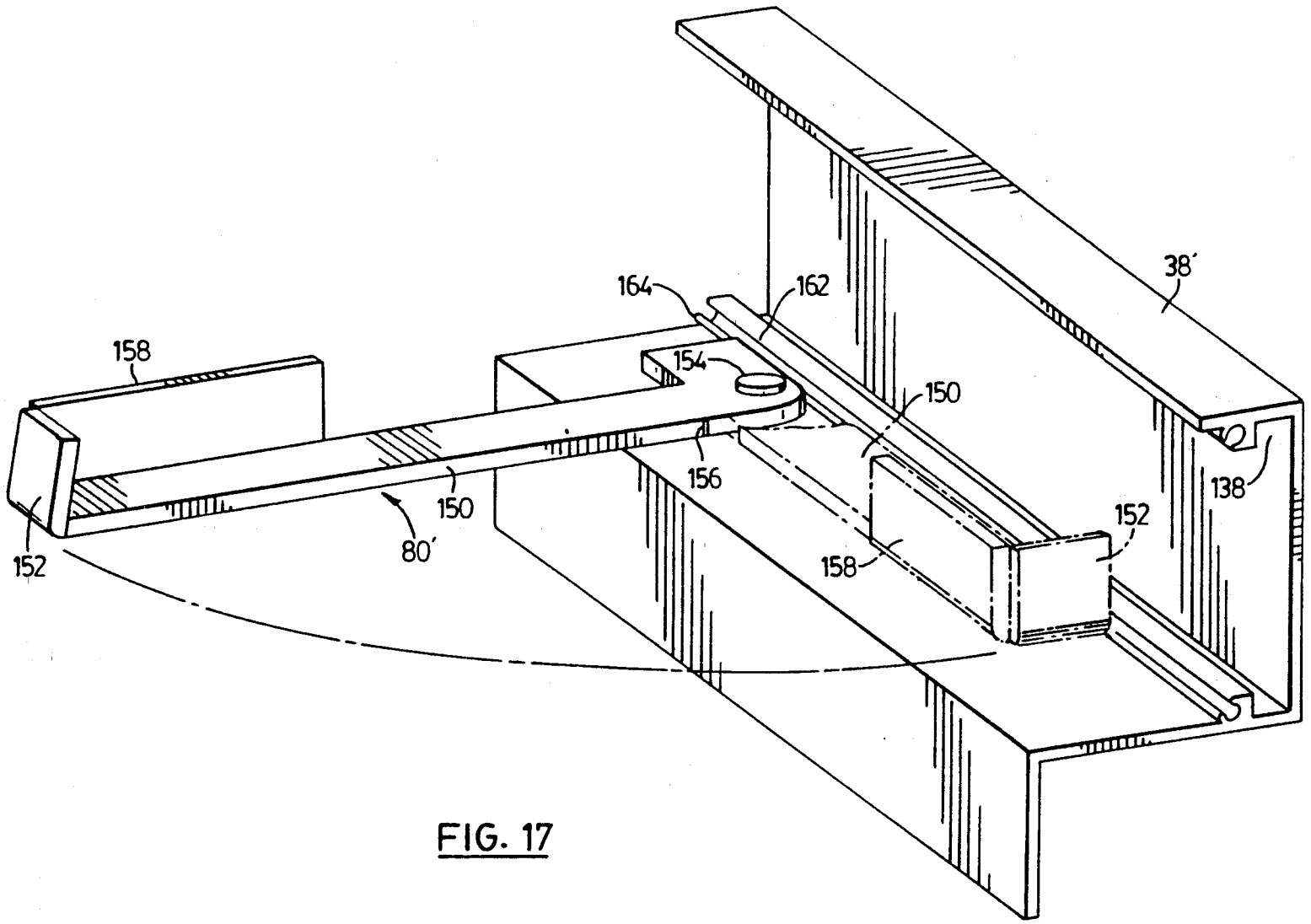
FIG. 17 is a perspective view similar to that of FIG. 18 but with the magnet, backing bar and shock absorber bracket removed to show the hold open bar in its two positions.

The stop member 80' is best shown in FIGS. 13, 16 and 17. As there shown, stop member 80' includes a flat bar 150 having an upwardly bent end 152. Bar 150 is secured to bracket 38' by a rivet 154 which extends through bracket 38'. One leg of a coil spring 156 extends over an edge of arm 150 and biases bar 152 to an extended position shown in full lines in FIGS. 16 and 17. However stop member 80' is normally retained in a retracted position shown in dotted lines in FIGS. 16 and 17 (and also shown in FIG. 13) when the panel member 28 is closed. As best shown in FIG. 16, when the panel member 28 is closed, a bent up side 158 of bar 150 is flush (FIG. 16) with the face 160 of the magnet 36' and contacts a portion of the striker plate 40 (not shown in FIGS. 16 and 17), thereby holding the stop member 80' in its retracted position.

When the panel is blown open, the spring 156 (which need not be particularly powerful) biases the stop member 80' outwardly to the full line position shown in FIGS. 16 and 17. In its extended position, which is at right angles to its retracted position, stop member 80' toward the panel 28'. Stop member 80' is pre-extends vented from pivoting too far by engagement of its rear edge 162 (FIG. 17) with extruded edge 164 of bracket 38'.

Next, when the panel 28' attempts to re-close, the surface of the striker plate 40' (or the shims thereon) contact and abut against the upturned end 152 of the stop member 80', preventing the panel from fully reclosing. This helps to avoid a damaging implosion or vacuum condition in the building being protected.

When the building occupants are ready to reclose the panel 28', they need simply rotate stop member 80' to its retracted position shown in dotted lines in FIGS. 16 and 17. Then the panel member 28' can be closed until the striker plate 40' (or the shims on it) contact the magnet face 160, thereby retaining the panel member in closed position.

While the cable 124 is shown as fastened to the centre of the panel, it can if desired be fastened off centre, or two cables can be used with separate shock absorbing brackets, one attached near each corner of the blow-open panel.

In addition, while the backing bar 136 is preferred, it can be eliminated. In that case magnet 36' would be bolted directly to channel 38', and the shock absorber bracket 132 would be bolted directly through bracket 38' to angle 142.

Although stop member 80' is shown connected to frame bracket 38', it could alternatively be connected to a bracket mounted on the panel and would then pivot toward the frame when the panel opens. In addition, while the stop member 80' is mounted in the middle of the channel for manufacturing convenience, it can be mounted off centre. Alternatively, two stop members can be used, one at each end of the panel, and attached either to the panel or to the frame.

In addition, the stop member 80', rather than being pivoted, can be fastened directly to the panel or frame with a flat U-shaped spring so that when the panel is released, the spring will move stop member 80' into the path of another component and block the panel from closing, thereby reducing the vacuum effect in the building after an over pressure condition. Alternatively, the hold open device can be made of resilient material such as rubber, having its normal shape deformed during the closing process. Then, when the panel is blown open, the hold open devices will assume their normal shape and interpose themselves between two components, preventing the panel from closing. However care should be taken to hold the panel far enough open that implosion forces will be sufficiently relieved.

While preferred embodiments of the invention have been described, it will be appreciated that various changes may be made within the scope of the appended claims.

We claim:

1. In a pressure relief panel assembly for protecting a building against over-pressure, said assembly including a frame having a inner edge, a panel having first and second ends and being pivotally coupled at said first end to said frame for movement between a normal closed position and a fully opened position in which said second end is spaced from said frame by a predetermined distance, and panel release means normally holding said panel in closed position but adapted to release when the panel is subjected to a predetermined blow-open pressure, the improvement comprising a hold-open mechanism for holding said panel, after it has been opened by over-pressure in said building, open to a limited extent in which said second end of said panel is spaced from said frame by a second distance which is substantially less than said predetermined distance, whereby to reduce the likelihood of damage due to implosion in said building, said hold-open mechanism comprising a stop member connected to one of said panel and said frame and having a first stop surface, said stop member being unconnected to the other of said panel and said frame, said stop member being of length not greater than said second distance, said hold-open mechanism further including a second stop surface associated with the other of said panel and said frame, said stop member being moveable from a first position in which said first stop surface is disengaged from said second stop surface when said panel is closed, to a second position when said panel is open in which said stop member extends between said panel and said frame and said first stop surface engages said second stop surface for holding said panel open by said second distance, and means biasing said stop member from said first position to said second position.

2. The invention as claimed in claim 1 wherein said assembly includes a first arm pivotally coupled to said frame, and a second arm pivotally connected to said first arm and pivotally coupled to said panel, for said arms to limit the extent to which said panel can pivot outwardly, said stop member being pivotally connected to said second arm.

3. The invention as claimed in claim 1 and including cable restraint means connected between said panel and said frame to limit the extent to which said panel can pivot outwardly.

4. The invention as claimed in claim 1 wherein said panel release means includes a magnet and striker, each of said magnet and striker having a contact face for said face of said magnet to contact said face of said striker to hold said panel in said normal closed position, one of said magnet and striker being mounted on said panel and the other being mounted on said frame, said stop member being pivotally connected to said panel above said one of said magnet and striker and extending toward and above the other of said magnet and striker when said panel is in said closed position, said means biasing including spring means connected to said stop member to bias said stop member, when said panel is fully open, to a position in which, when said panel begins to reclose, said first stop surface engages the face of the other of said magnet and said striker, said face of the other of said magnet and striker thereby comprising said second stop surface.

5. The invention as claimed in claim 1 wherein said panel assembly includes a linkage having a first arm coupled to said frame and a second arm coupled to said panel, said first and second arms being pivotally connected together for said linkage to limit the extent of opening of said panel, said first arm lying in a predetermined relationship relative to said second arm when said panel is open, said hold-open means comprising catch means coupled to said first and second arms and responsive to said first and second arms assuming said predetermined relation to then retain said arms in said predetermined relationship.

6. The invention as claimed in claim 5 wherein said catch comprises resilient means connected to one of said arms for catching and retaining the other of said arms.

7. The invention as claimed in claim 1 wherein said second distance is between two and ten inches.

8. The invention as claimed in claim 7 wherein said distance is between four and five inches.

9. The invention as claimed in claim 1 wherein said first position said top member extends parallel to said panel between said panel and a portion of said frame, and in said second position said stop member extends from one of said panel and said frame towards the other of said panel and said frame.

10. The invention as claimed in claim 9 wherein said stop member is pivotally connected to one of said frame and said panel.

11. In a pressure relief panel assembly for protecting a building against over-pressure, said assembly including a frame, a panel pivotally coupled to the frame for movement between a normal closed position and an opened position, and panel release means normally holding said panel in closed position but adapted to release when the panel is subjected to a predetermined blow-open pressure, said panel assembly including a linkage having a first arm coupled to said frame and a second arm coupled to said panel, said first and second arms being pivotally connected together for said linkage to limit the extent of opening of said panel, said first arm lying in a predetermined relationship relative to said second arm when said panel is open, the improvement comprising a hold-open mechanism for holding said panel at least partly open after it has been opened by over-pressure in said building, whereby to reduce the likelihood of damage due to implosion in said building, said hold-open mechanism comprising a U-shaped spring having a base and a pair of legs, said legs having inturned ends, said spring being connected to one of said arms, and said legs and base defining a space for receiving the other of said arms, said spring being dimensioned for said inturned ends to catch and retain said other of said arms when the other of said arms is received between the legs of said spring, said U-shaped spring thereby retaining said arms in said predetermined relationship when said panel is blown open.

12. The invention as claimed in claim 11 wherein said base of said spring is removably connected to said one arm by wing nut means.

13. The invention as claimed in claim 11 wherein said arms are pivotally connected together at a pivot pint, said one arm extending beyond said pivot point to form an arm extension, said spring being connected to said arm extension.

14. In a pressure relief panel assembly for protecting a building against over-pressure, said assembly including a frame, a panel pivotally coupled to the frame for movement between a normal closed position and an opened position, and panel release means normally holding said panel in closed position but adapted to release when the panel is subjected to a predetermined blow-open pressure, the improvement comprising a hold-open mechanism for holding said panel partly open after it has been opened by over-pressure in said building, whereby to reduce the likelihood of damage due to implosion in said building, said hold-open mechanism comprising a stop member coupled to one of said panel and said frame and having a first stop surface, said hold-open mechanism further including a second stop surface associated with the other of said panel and said frame, said stop member being moveable from a first position in which said first stop surface is disengaged from said second stop surface when said panel is closed, to a second position in which said first stop surface engages said second stop surface when said panel is open for preventing complete closure of said panel, and means biasing said stop member from said first position to said second position, and wherein said first position said stop member extends parallel to said panel between said panel and a portion of said frame, and in said second position said stop member extends from one of said panel and said frame towards the other of said panel and said frame.

15. The invention as claimed in claim 14 wherein said stop member is pivotally connected to one of said frame and said panel.

16. The invention as claimed in claim 15 wherein said stop member has a normal retracted position when said panel is closed, in which said stop member extends parallel to said panel between said panel and a portion of said frame, and said means biasing includes spring means for biasing said stop member to an extended position in which said stop member extends toward said panel when said panel is opened.

17. The invention as claimed in claim 14 wherein said panel release means includes a magnet and striker, each having ak face, one of said magnet and striker being mounted on said panel and the other on said frame, said second stop surface being the face of said other of said magnet and said striker.

18. The invention as claimed in claim 17 wherein said stop member is pivotally connected to said frame.

19. The invention as claimed in claim 18 wherein said stop member comprising a bar having first and second ends, said second end having an enlarged end surface, said magnet being connected to said frame, pivot means mounting said first end of said bar beneath said magnet for said bar to extend parallel to said face of said magnet and said enlarged end to contact said face of said striker when said panel is closed, said face of said striker forming said second stop surface.

20. The invention as claimed in claim 18 and including a support bracket connected to said frame, said magnet being coupled to said support bracket, and further including restraint means for limiting the extent to which said panel can open, said restraint means including a backer bar also connected to said support bracket, shock absorber means connected to said backer bar, and cable means connected between said shock absorber means and said panel.

21. In a pressure relief panel assembly for protecting a building against over-pressure, said assembly including a frame, a panel pivotally coupled to the frame for movement between a normal closed position and an opened position, and panel release means normally holding said panel in closed position but adapted to release when the panel is subjected to a predetermined blow-open pressure, the improvement comprising a hold-open mechanism for holding said panel partly open after it has been opened by over-pressure in said building, whereby to reduce the likelihood of damage due to implosion in said building, said hold-open mechanism comprising a stop member coupled to one of said panel and said frame and having a first stop surface, said hold-open mechanism further including a second stop surface associated with the other of said panel and said frame, said stop member being moveable from a first position in which said first stop surface is disengaged from said second stop surface when said panel is closed, to a second position in which said first stop surface engages said second stop surface when said panel is open for preventing complete closure of said panel, and means biasing said stop member from said first position to said second position and further including a support bracket connected to said frame, said stop member being pivotally connected to said support bracket, and further including restraint means for limiting the extent to which said panel can open, said restraint means including a backer bar also connected to said support bracket, shock absorber means connected to said backer bar, and cable means connected between said shock absorber means and said panel.

22. The invention as claimed in claim 21 wherein said panel release means includes a magnet and striker means, said second stop surface being formed by one of said magnet and said striker means.

* * * * *